US005295172A

United States Patent [19]

Liu

[11] Patent Number: 5,295,172

[45] Date of Patent: Mar. 15, 1994

[54] ENGINE LIFE COUNTER

[76] Inventor: Paul Liu, Room 1004, No. 600, Ming Chuan E. Road, Taipei, Taiwan

[21] Appl. No.: 818,956

[22] Filed: Jan. 10, 1992

[51] Int. Cl.[5] ..... G06M 3/12; G06M 1/08

[52] U.S. Cl. ..... 377/15; 377/86; 377/87

[58] Field of Search ..... 377/86, 87, 15

[56] References Cited

U.S. PATENT DOCUMENTS

| | | | |
|---|---|---|---|
| 3,246,127 | 4/1966 | Herndon et al. | 377/86 |
| 3,387,187 | 6/1968 | Haight | 377/86 |
| 3,668,374 | 6/1972 | Gamble | 377/86 |
| 4,630,292 | 12/1986 | Juricich et al. | 377/15 |

*Primary Examiner*—John S. Heyman
*Attorney, Agent, or Firm*—Browdy and Neimark

[57] ABSTRACT

An engine life counter electrically connected to an engine restart switch through a power source of an engine. The counter includes a mechanical type counter having a coil; a quartz crystal oscillating at a stable frequency; a frequency demultiplier having an output terminal and a reset input terminal. The frequency demultiplier is connected to the quartz crystal to produce a standard frequency output. A stabilizing circuit is connected between the power source and the reset input terminal to stabilize and filter power from the power source. A transistor circuit is connected to an input of the coil and the output terminal of the frequency demultiplier for producing a series of pulses in cooperation with the frequency demultiplier. The pulses magnetize the coil at predetermined intervals. When the restart switch is actuated to start the engine an output from the output terminal of the frequency demultiplier produces a first pulse through the transistor circuit after 32 seconds to magnetize the coil and thereafter produces a pulse through the transistor circuit which magnetizes the coil every 36 seconds until the engine is switched off. The first pulse thereby increases the accuracy of the counter when the engine is restarted.

1 Claim, 3 Drawing Sheets

ENGINE LIFE COUNTER

BACKGROUND OF THE INVENTION

The present invention relates to an engine life counter.

Conventional engine life counter works on the basis of the travel kilometer number shown on the odometer. However, such counter can not measure the idling motion of the engine. Thereby, the measured data will be quite different from the actual operation of the engine and great error exists therebetween. Another type of engine life counter adopts an oscillator to drive a stepped motor and reduced gears which further drive mechanical numeral wheels. Such structure is complicated and the cost thereof is high, and moreover, the error of tooth number of the gear always causes insufficent accuracy.

Still another type of counter employs an RC oscillating circuit to supply a series of pulses with 36 second period for magnetizing a coil of a mechanical counter. The oscillating frequency of such counter is apt to be interfered by the temperature or noise to cause a great error in oscillating frequency. Moreover, the oscillating frequency thereof must be corrected by a resistor so that a human error is easy to take place.

Another type of counter employs quartz crystal with 36 second oscillation period and ±0.1% accuracy.

SUMMARY OF THE INVENTION

It is a primary object of this invention to provide an engine life counter wherein an oscillating quartz crystal is adapted to perform a first magnetization 4 seconds earlier for increasing the accuracy and reducing the error to be within ±0.05% which is more accurate than the requirement of S.A.E. so that the error is minimized and the counting can be accurately performed.

It is a further object of this invention to provide the above counter the structure of which is simple and the cost thereof is lowered.

The present invention can be better understood through the following description and accompanying drawings wherein:

DETAILED DESCRIPTION OF THE PREFERRED EMBODIMENT

Figure 1:
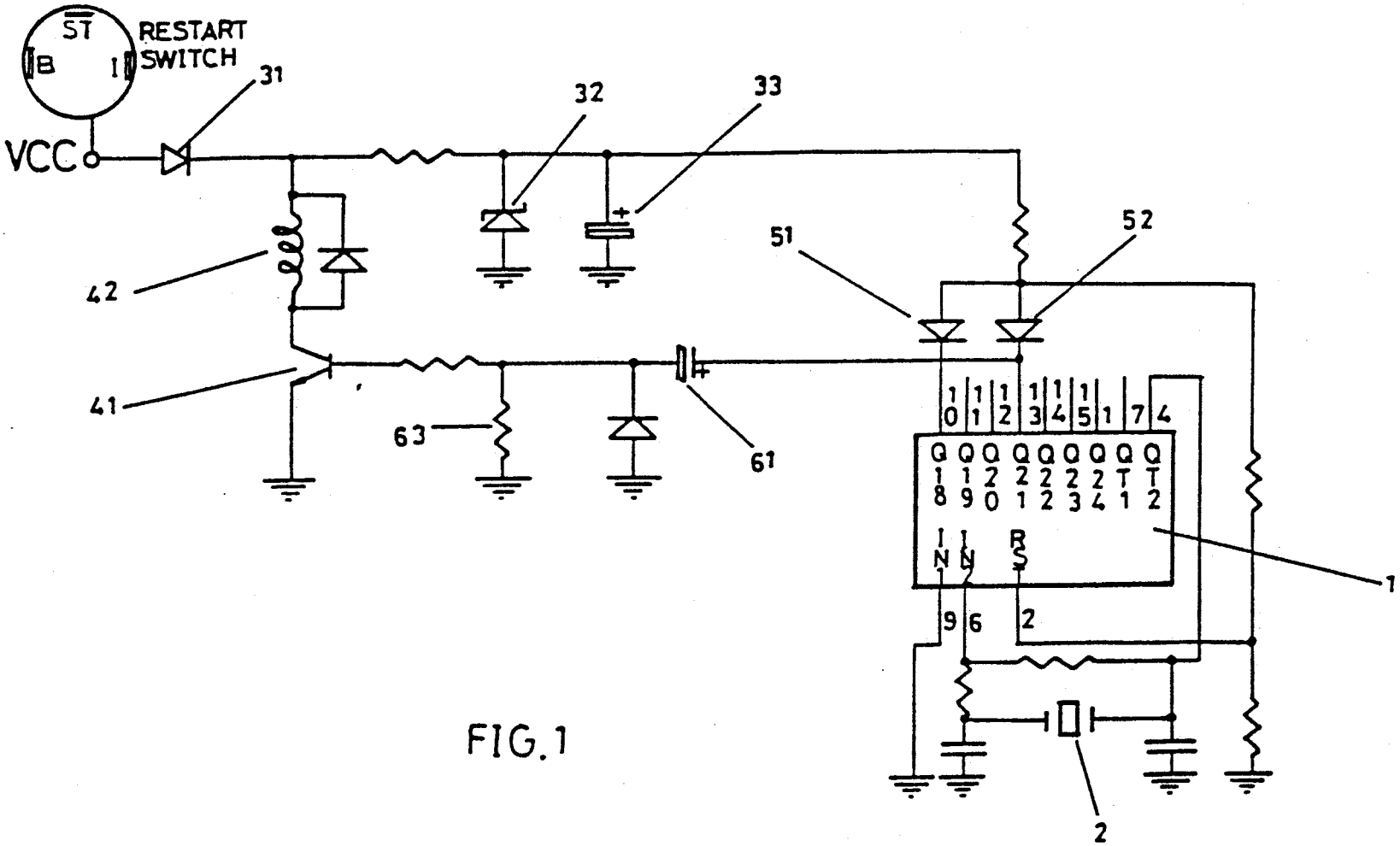
FIG. 1 is a circuit diagram of this invention.

As shown in FIG. 1, the present invention includes a quartz crystal 2 connected to an input terminal of a frequency demultiplier 1 with an output through Q18 and Q21 which are respectively connected to two diodes 51, 52 and then coupled to a reset input terminal RST of the frequency demultiplier, wherein Q21 is further through a capacitor 61 and a resistor 63 to the base of a transistor 41. The collector of the transistor 41 is connected to a coil 42 of a mechanical type of counter. The power from the power source Vcc is stabilized and filtered by a irreversible diode 31, a Zener diode 32 and a capacitor 33 and then supplied for the frequency demultiplier.

Figure 2:
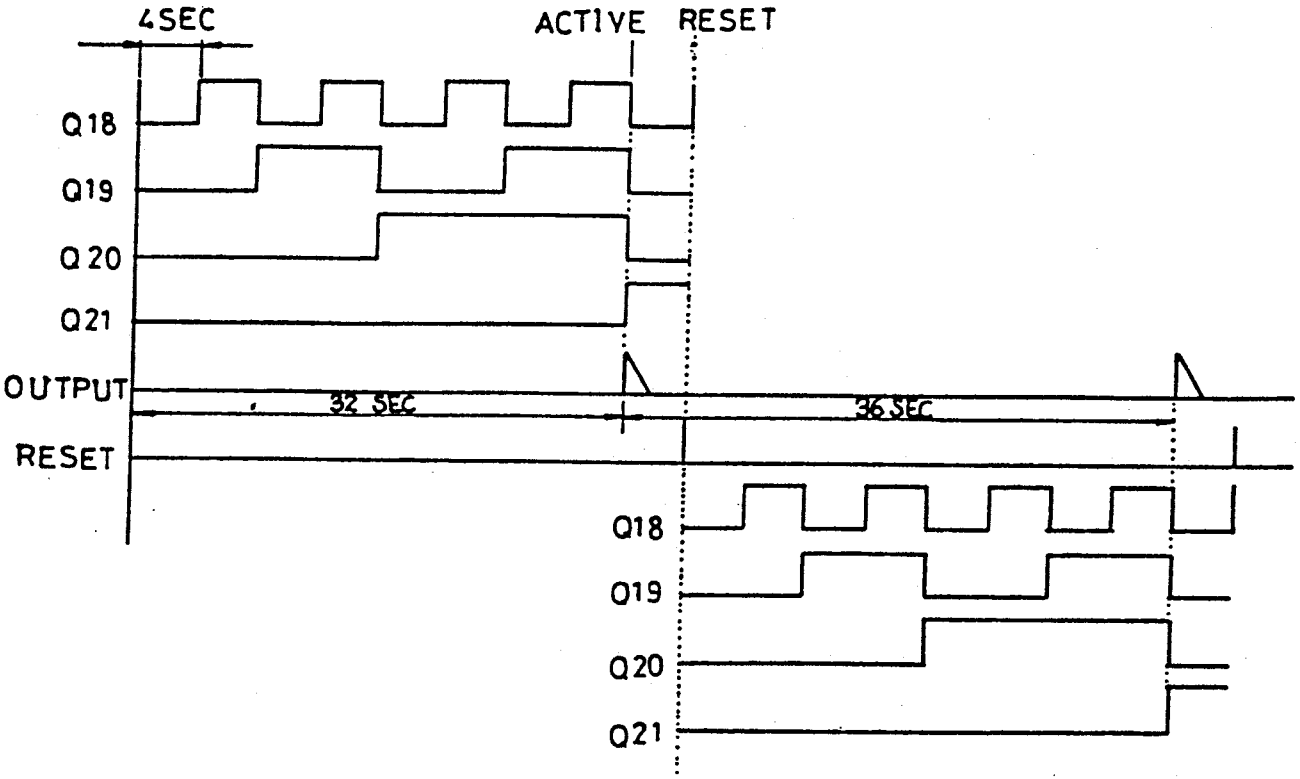
FIG. 2 is a diagram showing the wave shape of this invention.
Figure 3:
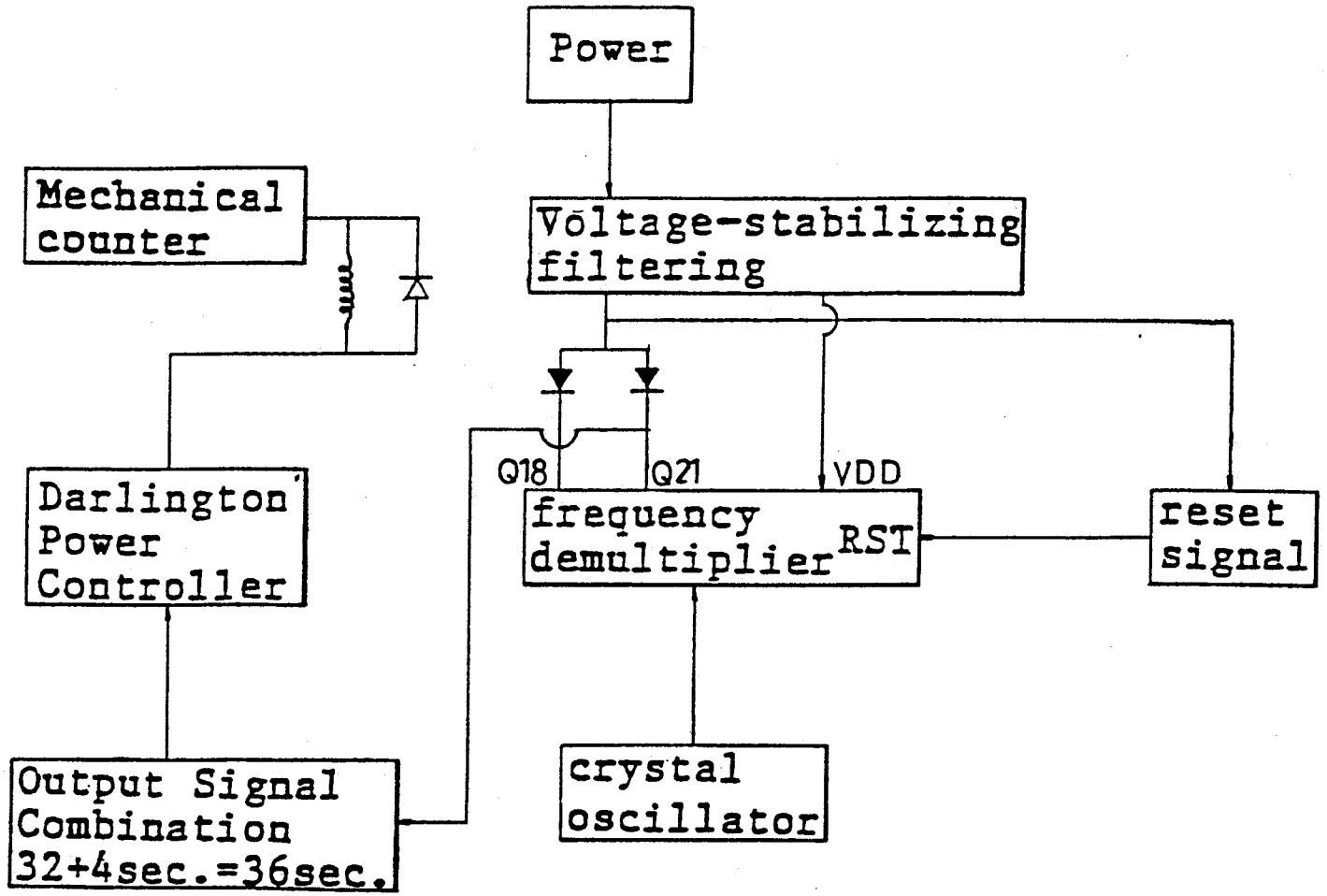
FIG. 3 is a block diagram, showing the flow chart of this invention.

According to the above arrangement, the quartz crystal 2 oscillates at a stable 32.768K Hz frequency and supplies the same for the frequency demultiplier 1 to serve as a standard frequency. When the power source is connected, i.e., the engine is stopped and then restarted by restart switch 34. When the engine is restarted, the Q21 of the frequency demultiplier 1 outputs a pulse with 32 second semi-period as shown in FIG. 2, which is differentiated by a capacitor 61 and resistor 63 to trigger the base of the transistor 41, making the same conductive. The engine switch 34 is connected to the Vcc as shown in FIG. 10. The switch has three points: B for battery; ST for start; I for ignition. The ignition point is coupled to Vcc as also shown in FIG. 1. The resistor 63 and the capacitor 61 form a differentiating circuit and the operation time of this circuit is determined by the constant C X R. The collector of the transistor 41 then produces current to magnetize the coil 42 of the counter. The first magnetization is performed 4 second earlier for increasing the accuracy and eliminating the error caused by the remaining period of the last magnetization when the engine stops. Thereafter, a periodic pulse will be produced during each 36 seconds to magnetize the coil of the counter. This is because that when the two outputs Q18 and Q21 of the frequency demultiplier are both under high potential, the two diodes are not conductive. At this time, the reset input terminal RST of the frequency demultiplier 1 works to zero respective output terminals thereof for re-working. The working flow chart is shown in FIG. 3. By means of the above operation, the data of the counter can be accurately controlled. Moreover, the structure is simple and the cost is lowered and the oscillating frequency is stable.

What is claimed is:

1. An engine life counter electrically connected to an engine restart switch through a power source of an engine, said counter comprising:

a mechanical type counter having a coil (42);

a quartz crystal (2) oscillating at a stable frequency;

a frequency demultiplier (1) having an output terminal and a reset input terminal;

said frequency demultiplier being connected to said quartz crystal (2) to produce a standard frequency output;

a stabilizing circuit connected between said power source and said reset input terminal, for stabilizing and filtering power from said power source, transistor means connected to an input of said coil (42) and said output terminal of said frequency demultiplier for producing a series of pulses in cooperation with said frequency demultiplier which magnetizes said coil at predetermined intervals, wherein, when said restart switch is actuated to start said engine an output from said output terminal of said frequency demultiplier produces a first pulse through said transistor means after 32 seconds to magnetize said coil and thereafter produces a pulse through said transistor means which magnetizes said coil every 36 seconds until said engine is switched off, said first pulse thereby increasing the accuracy of said counter when said engine is restarted.

* * * * *